US005683263A

United States Patent [19]

Hsu

[11] Patent Number: 5,683,263

[45] Date of Patent: Nov. 4, 1997

[54] COAXIAL CABLE CONNECTOR WITH ELECTROMAGNETIC INTERFERENCE AND RADIO FREQUENCY INTERFERENCE ELIMINATION

[76] Inventor: Cheng-Sheng Hsu, 5th Fl., No. 17, Alley 115, Fu Wei Street, Tainan, Taiwan

[21] Appl. No.: 754,041

[22] Filed: Dec. 3, 1996

[51] Int. Cl.[6] ..... H01R 13/62

[52] U.S. Cl. ..... 439/319; 439/311

[58] Field of Search ..... 439/311, 312, 439/314, 317, 318, 319, 578–585

[56] References Cited

U.S. PATENT DOCUMENTS

| | | | |
|---|---|---|---|
| 366,571 | 5/1887 | Cripps | 439/319 |
| 3,332,052 | 7/1967 | Rusinyak | 439/318 |
| 4,746,305 | 5/1988 | Nomura | 439/319 |

*Primary Examiner*—Hien Vu

*Attorney, Agent, or Firm*—Morton J. Rosenberg; David I. Klein

[57] ABSTRACT

A coaxial cable connector includes a body having an annular flange formed on an outer periphery thereof. A cylindrical member extends upwardly from an upper side of the body and has an axial hole defined therein. A sleeve is mounted around the cylindrical member for securing a peripheral conductor of an electric wire between the cylindrical member and the sleeve. An upper washer, a retaining ring, a spring washer, and a lower washer are mounted around the body. A barrel is mounted to engage with the upper washer for allowing the coaxial cable connector to be plugged into a socket member. An insulating collar is mounted in a bore defined in the body and around the center conductor. The insulating collar is made of ferro-ceramic material for eliminating external electromagnetic interference and radio frequency interference as well as internal undesired signals.

1 Claim, 1 Drawing Sheet

COAXIAL CABLE CONNECTOR WITH ELECTROMAGNETIC INTERFERENCE AND RADIO FREQUENCY INTERFERENCE ELIMINATION

BACKGROUND OF THE INVENTION

1. Field of the Invention

The present invention relates to a coaxial cable connector which may eliminate electromagnetic interference and radio frequency interference.

2. Description of the Related Art

Coaxial cable connectors have been widely applied to power supplies of electric appliances and to connect signal cables, and a typical one of which is shown in U.S. Pat. No. 4,037,909 to Trompeter et al. Electric appliances, e.g., electric fans, motors of air conditioners, refrigerators, wireless telephones, may generate undesired signals. Thus, a basic need of the coaxial cables is to be insulated from the above-mentioned interference sources, i.e. the coaxial cable connectors must eliminate radio frequency interference and electromagnetic interference as well as eliminate internal undesired signals. U.S. Pat. No. 4,720,271 to Grange discloses a hermetic coaxial connector in which an insulating glass bead is sealed to the central contact and an annular ring housed at least partly in a recess of the housing. U.S. Pat. No. 3,649,956 to Vrobel discloses a replaceable electrical connector which includes a ceramic insert 40 so as to permit the receptacle 10 to be employed in relatively high-temperature environments or where the coupled transducer generates a large amount of heat. Nevertheless, none of these patents teach prevention or elimination of electromagnetic interference and radio frequency interference.

Therefore, there has been a long and unfulfilled need for an improved coaxial cable connector which mitigates and/or obviates the above problems.

SUMMARY OF THE INVENTION

The present invention provides a coaxial cable connector for electric connection with an electric wire having a peripheral conductor and a center conductor. The coaxial cable connector comprises a body including an annular flange formed on an upper portion of an outer periphery thereof, thereby forming a first shoulder at a bottom of the annular flange. The body further includes a cylindrical member extending upwardly from an upper side thereof and having an axial hole defined therein. The body further includes a bore therein in communication with the axial hole, the bore having a diameter greater than that of the axial hole. An annular groove is defined in a lower portion of the outer periphery of the body.

A sleeve is mounted around the cylindrical member for securing the peripheral conductor of the electric wire between the cylindrical member and the sleeve. A retaining ring is securely mounted in the annular groove of the body. An upper washer is engaged with the first annular shoulder of the body. A spring washer is biased between the retaining ring and the upper washer for biasing the upper washer to engage with the first annular shoulder of the body. A lower washer is mounted around the body at a position below the retaining ring.

A barrel includes an annular projection extending radially and inwardly from an upper portion of an inner periphery thereof for engaging with the upper washer. The barrel further includes a second annular shoulder formed in a mediate portion of the inner periphery thereof for engaging with the lower washer. The upper washer may be moved toward the retaining ring against the resilient ring by the barrel for allowing the coaxial cable connector to be plugged into a socket member. An insulating collar and an insulating tube are mounted in the bore of the body and around the center conductor. The insulating collar is made of ferro-ceramic material for eliminating external electromagnetic interference and radio frequency interference as well as internal undesired signals.

Other objects, advantages, and novel features of the invention will become more apparent from the following detailed description when taken in conjunction with the accompanying drawings.

DESCRIPTION OF THE PREFERRED EMBODIMENT

Figure 2:
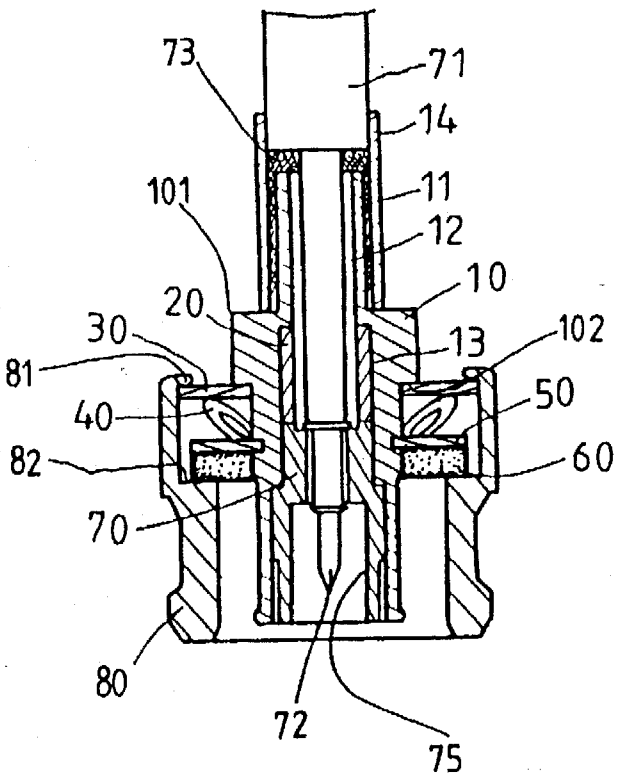
FIG. 2 is a cross sectional view of the coaxial cable connector in accordance with the present invention.
Figure 1:
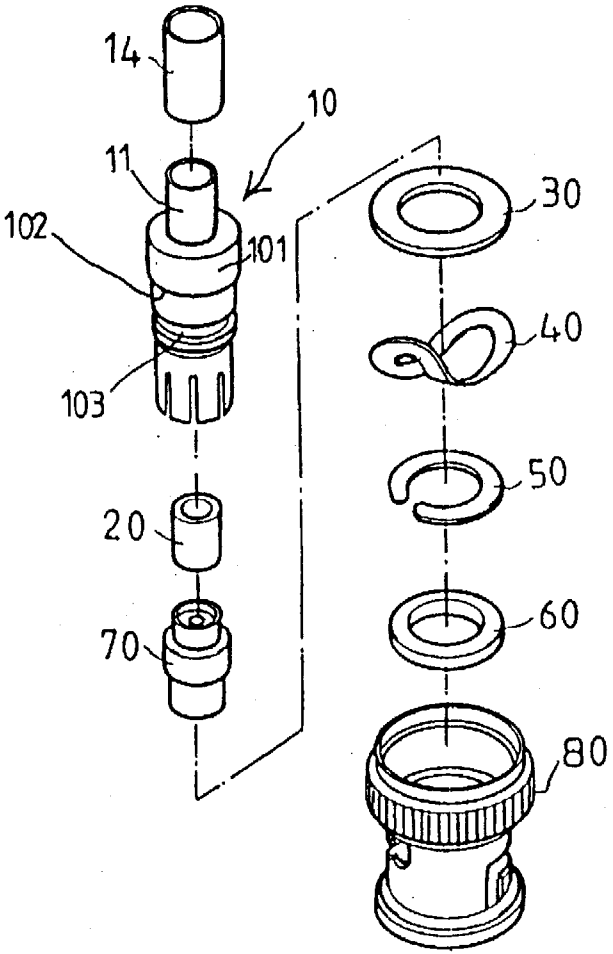
FIG. 1 is an exploded perspective view of a coaxial cable connector in accordance with the present invention.

Referring to FIGS. 1 and 2, a coaxial cable connector in accordance with the present invention generally includes a body 10, an insulating collar 20, an upper washer 30, a spring washer 40, a retaining ring 50, a lower washer 60, an insulating tube 70, and a barrel 80.

The body 10 includes an annular flange 101 formed on an upper portion of an outer periphery thereof, thereby forming a shoulder 102 at a bottom of the flange 101 for engaging with the washer 30. The body 10 further includes a cylindrical member 11 extending upwardly from an upper side thereof and having an axial hole 12 defined therein. Referring to FIG. 2, the body 10 further includes a bore 13 therein in communication with the axial hole 12. The bore 13 has a diameter greater than that of the axial hole 12. In addition, a sleeve 14, preferably made of copper, is mounted around the cylindrical member 11 so as to secure a peripheral conductor 73 of an electric wire 71 between the cylindrical member 11 and the sleeve 14. Furthermore, an annular groove 103 is defined in a lower portion of the outer periphery thereof for securely receiving the retaining ring 50.

The lower washer 60 is mounted around the body 10 at a position below the retaining ring 50. The spring washer 40 is biased between the retaining ring 50 and the upper washer 30 for biasing the upper washer 30 to engage with the shoulder 102 of the body 10. The barrel 80 includes a projecting ring 81 with an internal diameter greater than an outer diameter of the upper washer 30. The barrel 80 further includes an annular shoulder 82 formed in a mediate portion of the inner periphery thereof for engaging with the lower washer 60 such that the barrel 80 may move the washer 30 toward the retaining ring 50 against the resilient ring 40 and such that the coaxial cable connector may be plugged into a socket member (not shown), thereby preventing inadvertent damage to a central conductor 72 of the electric wire 71 when engaged to the socket member.

As can be seen in FIG. 2, the center conductor 72 of the electric wire 71 is extended through the axial hole 12 of the cylindrical member 11, the insulating collar 20, and then extended into the insulating tube 70. The insulating tube 70 includes a hole 75 defined therein for engaging with the socket member. The projecting ring 81 is deformed inwardly to retain the assembled components in the barrel 80, i.e., the projection ring 81 can be deemed as an annular projection extending radially and inwardly from an upper portion of an inner periphery thereof.

The insulating collar 20 is cylindrical and preferably made of ferro-ceramic material for being isolated from external undesired signals and for eliminating internal undesired signals. This is because some undesired signals (which may be generated due to the material of the internal wires and the equipments of the system using the internal wires) may be generated during transmission inside the internal wires. Insertion of the ferro-ceramic insulating collar may effectively eliminate the radio frequency interference and the electromagnetic interference. The ferro-ceramic material does not attenuate nor oxidize in almost all kinds of environment, and when the ferro-ceramic insulating collar is mounted around the electric wire, local rising of impedance occurs since a flow of the current of the electric wire is obstructed by the resistance thereof.

Although the invention has been explained in relation to its preferred embodiment, it is to be understood that many other possible modifications and variations can be made without departing from the spirit and scope of the invention as hereinafter claimed.

What is claimed is:

1. A coaxial cable connector for electric connection with an electric wire having a peripheral conductor and a center conductor, the coaxial cable connector comprising:

a body including an annular flange formed on an upper portion of an outer periphery thereof, thereby forming a first shoulder at a bottom of the annular flange, the body further including a cylindrical member integrally formed from said body and which extends upwardly from an upper side thereof and which has an axial hole defined therein, the body further including a bore therein having a diameter greater than that of the axial hole, the body further including an annular groove define in a lower portion of the outer periphery thereof;

a sleeve directly mounted around an outer wall surface of the cylindrical member for securing the peripheral conductor of the electric wire between the cylindrical member and the sleeve;

a retaining ring securely mounted in the annular groove of the body;

an upper washer engaged with the first annular shoulder of the body;

a spring washer biased between the retaining ring and the upper washer for biasing the upper washer to engage with the first annular shoulder of the body;

a lower washer mounted around the body at a position below the retaining ring;

a barrel including an annular projection extending radially and inwardly from an upper portion of an inner periphery thereof for engaging with the upper washer, the barrel further including a second annular shoulder formed in a mediate portion of the inner periphery thereof for engaging with the lower washer, the upper washer being moved toward the retaining ring against the resilient ring by moving the barrel for resiliently plugging the coaxial cable connector into a socket member; and an insulating collar and an insulating tube mounted in the bore of the body and around the center conductor, the insulating collar being made of ferro-ceramic material for eliminating external electromagnetic interference and radio frequency interference as well as internal undesired signals.

* * * * *